US007521617B1

(12) United States Patent
McMurray

(10) Patent No.: US 7,521,617 B1
(45) Date of Patent: Apr. 21, 2009

(54) GUITAR DISPLAY ARRANGEMENT

(76) Inventor: Jeffrey L McMurray, P.O. Box 1509, Rockport, TX (US) 78381

( * ) Notice: Subject to any disclaimer, the term of this patent is extended or adjusted under 35 U.S.C. 154(b) by 288 days.

(21) Appl. No.: 11/521,901

(22) Filed: Sep. 15, 2006

(51) Int. Cl.
*G10D 13/02* (2006.01)

(52) U.S. Cl. ..... 84/421

(58) Field of Classification Search ..... 84/327, 84/329, 421
See application file for complete search history.

(56) References Cited

U.S. PATENT DOCUMENTS

| | | | | |
|---|---|---|---|---|
| 4,037,815 | A | 7/1977 | DeLano | |
| 4,182,505 | A | 1/1980 | Cobin | |
| 5,363,734 | A * | 11/1994 | Wilenken | 84/327 |
| 5,372,346 | A * | 12/1994 | Upchurch et al. | 248/304 |
| 6,204,440 | B1 | 3/2001 | Yu | |
| 6,231,018 | B1 | 5/2001 | Barbieri | |
| 6,281,417 | B1 | 8/2001 | Ladao | |
| 6,685,283 | B2 | 2/2004 | Gembar et al. | |
| 2006/0081110 | A1 | 4/2006 | Bridges | |
| 2006/0081111 | A1 | 4/2006 | Bridges | |

FOREIGN PATENT DOCUMENTS

| | | |
|---|---|---|
| CA | 2465999 | 12/2004 |
| DE | 19507681 | 9/1996 |
| FR | 2582846 | 12/1986 |
| GB | 2293910 | 10/1996 |

* cited by examiner

*Primary Examiner*—Kimberly R Lockett
(74) *Attorney, Agent, or Firm*—Michael Ries

(57) ABSTRACT

Apparatus for suspending and displaying a guitar by a plurality of mounting plates having projecting dowels having an enlarged end for the suspending of a strap fob that is easily attached to a guitars existing strap fastening hardware. The present invention also allows the user to display a guitar with minimum exposure of the supporting mounting elements delivering a more aesthetic guitar display.

7 Claims, 8 Drawing Sheets

GUITAR DISPLAY ARRANGEMENT

BACKGROUND OF THE INVENTION

1. Field of the Invention

The present invention relates generally to displays and, more specifically, to a device for suspending and displaying a guitar comprising a plurality of brackets having a projecting dowel for the attachment of a fob strap thereto that may be easily attached to a guitar's existing strap attachment hardware.

The present invention is used in a manner whereby the user mounts a plurality of mounting plates to a wall in an arrangement whereby the mounting hardware is plate-like having a cantilevered dowel and strap fob that slips thereover.

2. Description of the Prior Art

There are other display devices designed for displaying guitars Typical of these is U.S. Pat. No. 4,037,815 issued to DeLano on Jul. 26, 1977.

Another patent was issued to Corbin on Jan. 8, 1980 as U.S. Pat. No. 4,182,505 Yet another U.S. Pat. No. 6,204,440 was issued to Yu on Mar. 20, 2001 and still yet another was issued on May 15, 2001 to Barbieri as U.S. Pat. No. 6,231,018.

Another patent was issued to Ladao on Aug. 28, 2001 as U.S. Pat. No. 6,281,417. Yet another U.S. Pat. No. 6,685,283 was issued to Gember et al on Feb. 3, 2004. Another application was published to Bridges on Apr. 20, 2006 as U.S. Patent Application No. 2006/0081110 and still yet another was published on Apr. 20, 2006 to Bridges as U.S. Patent No. 2006/0081111.

Another patent was issued to Baratay on Dec. 5, 1966 as French Patent No. FR2582846. Yet another U.K. Patent No. GB2293910 was issued to Reed on Nov. 4, 1996. Another was issued to Fleischer on Sep. 12, 1996 as German Patent No. DE19507661 and still yet another was issued on Dec. 17, 2004 to Wilfer as Canadian Patent No. CA2465999.

U.S. Pat. No. 4,037,815

Inventor: Auther D. DeLano

Issued: Jul. 26, 1977

A musical instrument support for holding an instrument on a wall mounted bracket in elevated position above the floor. The instrument support is detachable from the bracket and is collapsible from a position in which it holds the instrument to a transport or storage position and is provided with scales to facilitate unfolding the instrument support to a desired size to accommodate a given instrument.

U.S. Pat. No. 4,182,505

Inventor: Robert B. Cobin

Issued: Jan. 8, 1980

A musical instrument, supported between longitudinal extensions which project from a lateral base portion of a hanger, is protected from marring by tubular bodies which cover the longitudinal extensions. Elongated flexible retaining means attached to the tubular bodies are wrappable about the lateral base portion to provide a protective covering on the lateral base portion and to retain the associated tubular body on the respective longitudinal extension. A fastener on the retaining means holds the retaining means in wrapped relation on the lateral base portion.

U.S. Pat. No. 6,204,440

Inventor: Ming Ti Yu

Issued: Mar. 20, 2001

A guitar holder device has a U-shaped hanger, an L-shaped rod disposed on the U-shaped hanger, a holder joint disposed on an end of the L-shaped rod, a disk inserted in the holder joint pivotally, and a U-shaped bar connected to the disk. A bolt fastens the disk in the holder joint. The holder joint has a U-shaped main body, a positioning through hole formed on the U-shaped main body, an oblong through hole formed on the U-shaped main body, a rivet passing through the oblong through hole and a washer, and a bolt passing through the positioning through hole, the disk, and a nut.

U.S. Pat. No. 6,231,018

Inventor: Mark Barbieri

Issued: May 15, 2001

A guitar hanger includes a base member operable to attach to a substantially vertically oriented plane, the base member forming an aperture with the plane; and a hanger member including two spaced apart substantially longitudinally disposed rods, the rods having respective ends terminating at a coupling portion and respective distal ends defining an opening region for receiving a guitar neck, wherein the coupling portion is operable to engage the aperture such that the hanger member removably connects to the base member, the rods extending outward from the plane when the coupling portion engages the aperture.

U.S. Pat. No. 6,281,417

Inventor: Lawrence N. Ladao

Issued: Aug. 28, 2001

A musical instrument stand, for mounting and display of one or a plurality of musical instruments such as a guitar. The device features an elongated member that is either attachable to a wall or floor mounted. Instruments are mounted between a pair of upper and lower instrument mounts or clusters of mounting brackets, each having a rotatable support bars to contact the side of the guitar when the mounting brackets are slid toward each other on a slidable mount to the elongated member. Angled ends of the support bars restrain the instrument in the stand when the support bars are rotated to place the angled ends in front of the mounted instrument. Abrasion of the instrument surface is avoided using a slideable cushion on each support bar that insulates the instrument surface from the support bar during rotation. A lockable cover optionally prevents removal of the instrument from its mount without first unlocking the cover.

U.S. Pat. No. 6,685,283

Inventor: Richard Gembar

Issued: Feb. 3, 2004

A cabinet for display of a stringed musical instrument, wherein the stringed musical instrument is oriented horizontally and is held in place within the cabinet by the supports which engage the strap buttons of the instrument. The device is optionally attachable to a wall. In one embodiment, the supports are angled brackets with notches for receiving the strap buttons. A protective material is applied on each support and the interior surface of the cabinet to avoid abrasion of the instrument surface. The orientation of the angled brackets is such that the visible profile of the brackets is very small when an instrument is displayed in the cabinet.

U.S. Patent Application Number 2006/0081110

Inventor: Douglas Miles Bridges

Issued: Apr. 20, 2006

One piece guitar hanger apparatus for displaying a guitar on a wall in playing position with support braces that allow the insertion of each strap button which supports the weight of the guitar, a main body to hold the support braces in the proper position, and a support dowel to prohibit the guitar from tilting.

U.S. Patent Application Number 2006/0081111

Inventor: Douglas Miles Bridges

Issued: Apr. 20, 2006

Two piece guitar hanger apparatus for displaying a guitar on a wall in playing position with support braces that allow the insertion of each strap button which supports the weight of the guitar, a support dowel to prohibit the guitar from tilting, and a spacer for angled peg head guitar models to maintain sufficient space as to keep the peg head from touching the wall.

French Patent Number FR2582846

Inventor: Baratay Claude

Issued: Dec. 6, 1966

The subject of the invention is a bracket as an accessory for musical stringed instruments, whereby such instruments may be hung perfectly safely on a wall with no danger of their falling. This device shown in the attached drawing, comprises a main part or fork 1 from which the instrument is hung in the junction between the head and the arm of the latter. This main part is supported by a buttress or shoulder 2 at an obtuse angle of approximately 95 DEG and the main part is provided with a removable retaining rod 3 which is put in position when the instrument has been hung up.

U.K. Patent Number GB2293910

Inventor: Robert Anthony Reed

Issued: Nov. 6, 1994

In the display mode FIG. 3, the entire weight of the guitar is taken at the bottom, thereby eliminating the stress produced when hanging from the neck. The use of a strap 2 at the neck and a rear grommet support for the sling button, eliminates movement. In the display mode FIG. 5, legs 3 are part folded back and fixed to provide a tripod support. Use of a front grommet support 11 for the sling button 9 aids the stability. The logs are hidden behind the guitar.

German Patent Number DE19507681

Inventor: Herbert Fleicher

Issued: Sep. 12, 1996

Guitar or similar instrument is mounted on a wall using amounting having two arms (3, 4) arranged in the form of a two-tined fork, such that at least one of the arms can be moved separately in the direction of the other arm on a fixing housing. Pref. both arms are movable, each arm having an angled section by which it can be swivelled on the housing. Each arm pref. encloses an angle of 2-10 deg. w.r.t. its axis of rotation. Arms are pref. coated by injection moulding on a core (7, 8) with a slip-preventing agent, partic. polypropylene-ethylene/propylene terpolymer.

Canadian Patent Number CA2465999

Inventor: Hans-Peter Wilfer

Issued: Dec. 17, 2004

The invention relates to a wall holder for at least one musical instrument having a neck or a similar taper, in particular a guitar or bass guitar, comprising a mounting (2) which is fastened or can be fastened to the wall and at least two support elements (3) which are arranged on the mounting can be inserted between those of the neck of the musical instrument, the neck and/or the head (15) of the musical instrument abutting against the support elements (3), and is characterized in that the mounting (2) has at least one guide bar bracket for the support elements (3) via which the support elements (3) can be moved relative to one another.

While these display devices are suitable for the purposes for which they were designed, they would not be as suitable for the purposes of the present invention, as hereinafter described.

SUMMARY OF THE PRESENT INVENTION

A primary object of the present invention is to provide a device for displaying a guitar whereby the guitar may be suspended utilizing the existing strap hardware.

Another object of the present invention is to provide a device for displaying a guitar utilizing a plurality of mounting plates having dowels whereby a fob strap may be fitted for attachment to a guitar.

Yet another object of the present invention is to provide a device for displaying a guitar utilizing mounting plates that are easily concealable behind a suspended guitar for an enhanced aesthetic appearance Still yet another object of the present invention is to provide a device for mounting guitars utilizing a flexible attachment means.

Another object of the present invention is to provide a device for suspending a guitar utilizing dowels having an enlarged end portion to assist restraining the fob strap from casual displacement.

Additional objects of the present invention will appear as the description proceeds.

The present invention overcomes the shortcomings of the prior art by providing a device for suspending and displaying a guitar by a plurality of mounting plates having projecting dowels having an enlarged end for the suspending of a strap fob that is easily attached to a guitars existing strap fastening hardware. The present invention also allows the user to display a guitar with minimum exposure of the supporting mounting elements delivering a more aesthetic guitar display.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
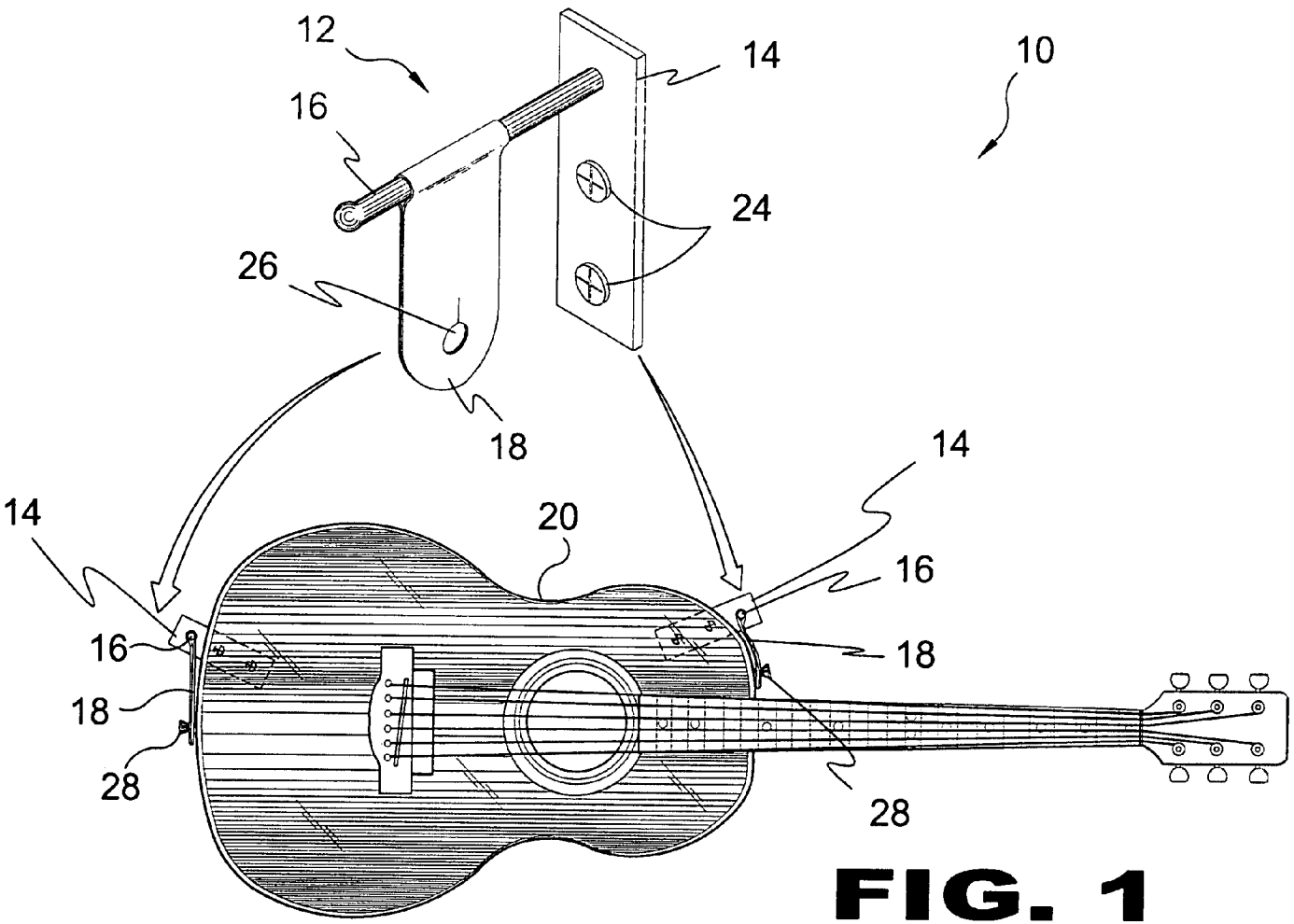
FIG. 1 is an illustrative view of the present invention.

Turning now descriptively to the drawings, in which similar reference characters denote similar elements throughout the several views, the figures illustrate the Guitar Hanger Apparatus of the present invention. With regard to the reference numerals used, the following numbering is used throughout the various drawing figures.

10 Guitar Hanger Apparatus of the present invention
12 mounting bracket assembly
14 mounting plate
16 dowel
18 fob strap
20 guitar
22 mounting aperture of 14
24 hardware
26 recess of 18
28 strap peg of 20
30 mounting channel of 18
32 wall

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

FIG. 1 is an illustrative view of the present invention 10. The present invention is a two piece guitar hanger apparatus 10 for resting or displaying a guitar 20 in a horizontal or playing position having two brackets assemblies 12, each providing a mounting plate 14 including a dowel 16 that receives a fob 18, resembling the end of a guitar strap. Each mounting plate 14 has a pair of mounting apertures 22 to secure the mounting plate 14 to a wall or cabinet with appropriate hardware 24 such as a screw or molly. The fob 18 provides a recess 26 to accept the strap pegs 28 of a guitar 20 to removably secure it to the bracket dowel 16. Each fob 18 is removable from the dowel 16.

Figure 2:
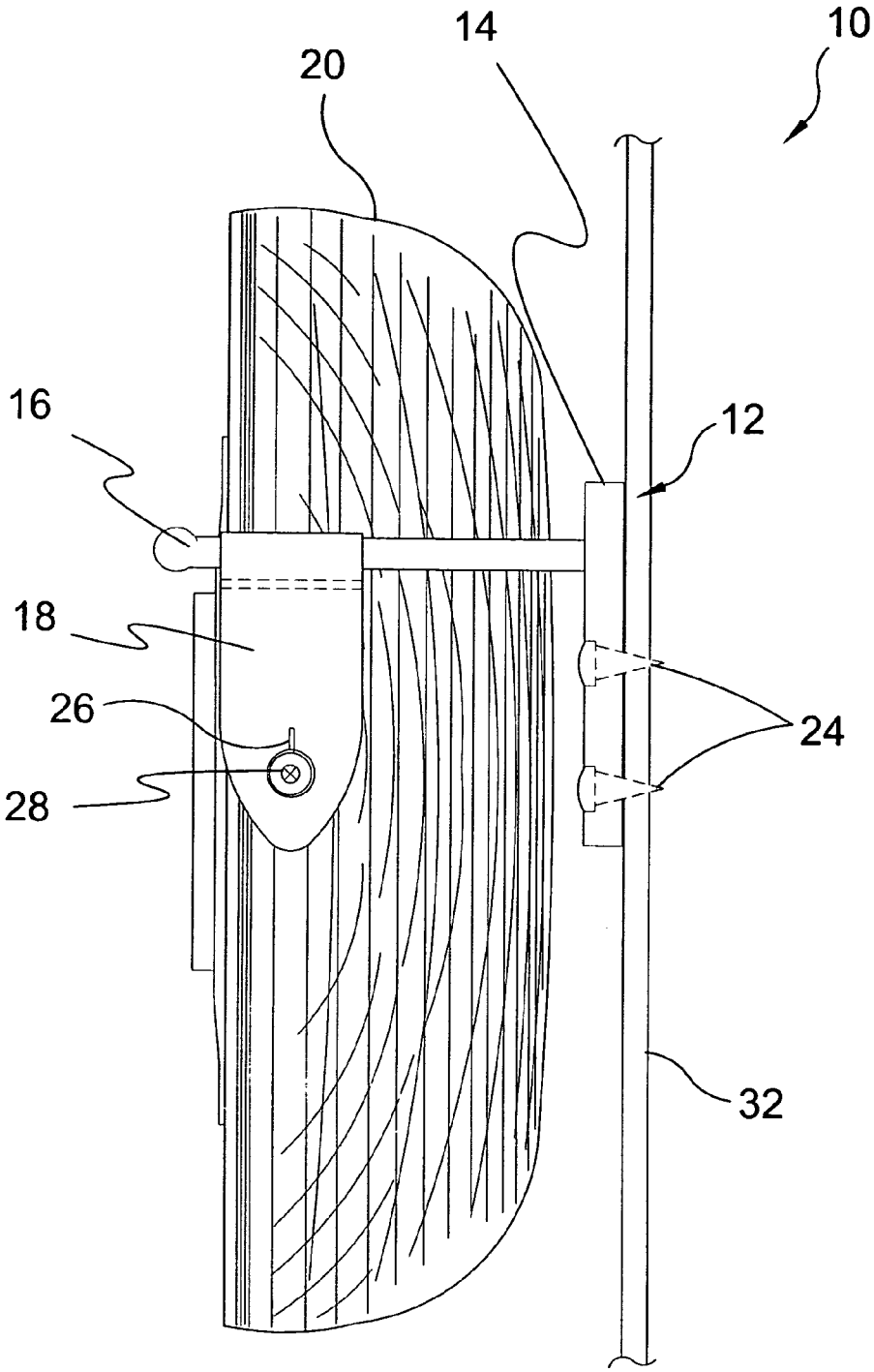
FIG. 2 is a side of the present invention in use.

FIG. 2 is a side view of the present invention 10 in use. The present invention is a two piece guitar hanger apparatus 10 for resting or displaying a guitar 20 in a horizontal or playing position having two brackets assemblies 12, each providing a mounting plate 14 including a dowel 16 that receives a fob 18, resembling the end of a guitar strap. Each mounting plate 14 has a pair of mounting apertures 22 to secure the mounting plate 14 to a wall 32 or cabinet with appropriate hardware 24 such as a screw or molly. The fob 18 provides a recess 26 to accept the strap pegs 28 of a guitar 20 to removably secure it to the bracket dowel 16. Each fob 18 is removable from the dowel 16.

Figure 3:
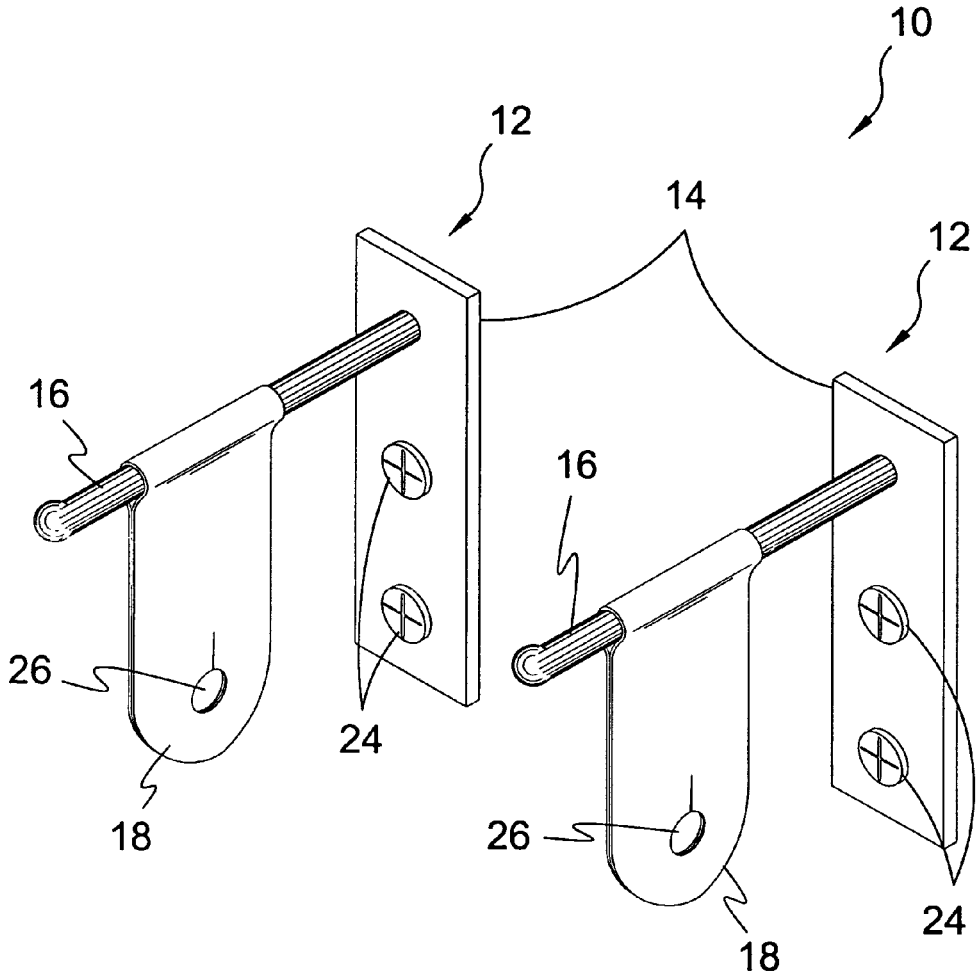
FIG. 3 is a perspective view of the present invention.

FIG. 3 is a perspective view of the present invention 10. The present invention is a two piece guitar hanger apparatus 10 for resting or displaying a guitar in a horizontal or playing position having two brackets assemblies 12, each providing a mounting plate 14 including a dowel 16 that receives a fob 18, resembling the end of a guitar strap. Each mounting plate 14 has a pair of mounting apertures 22 to secure the mounting plate 14 to a wall or cabinet with appropriate hardware 24 such as a screw or molly. The fob 18 provides a recess 26 to accept the strap pegs of a guitar to removably secure it to the bracket dowel 16. Each fob 18 is removable from the dowel 16.

Figure 4:
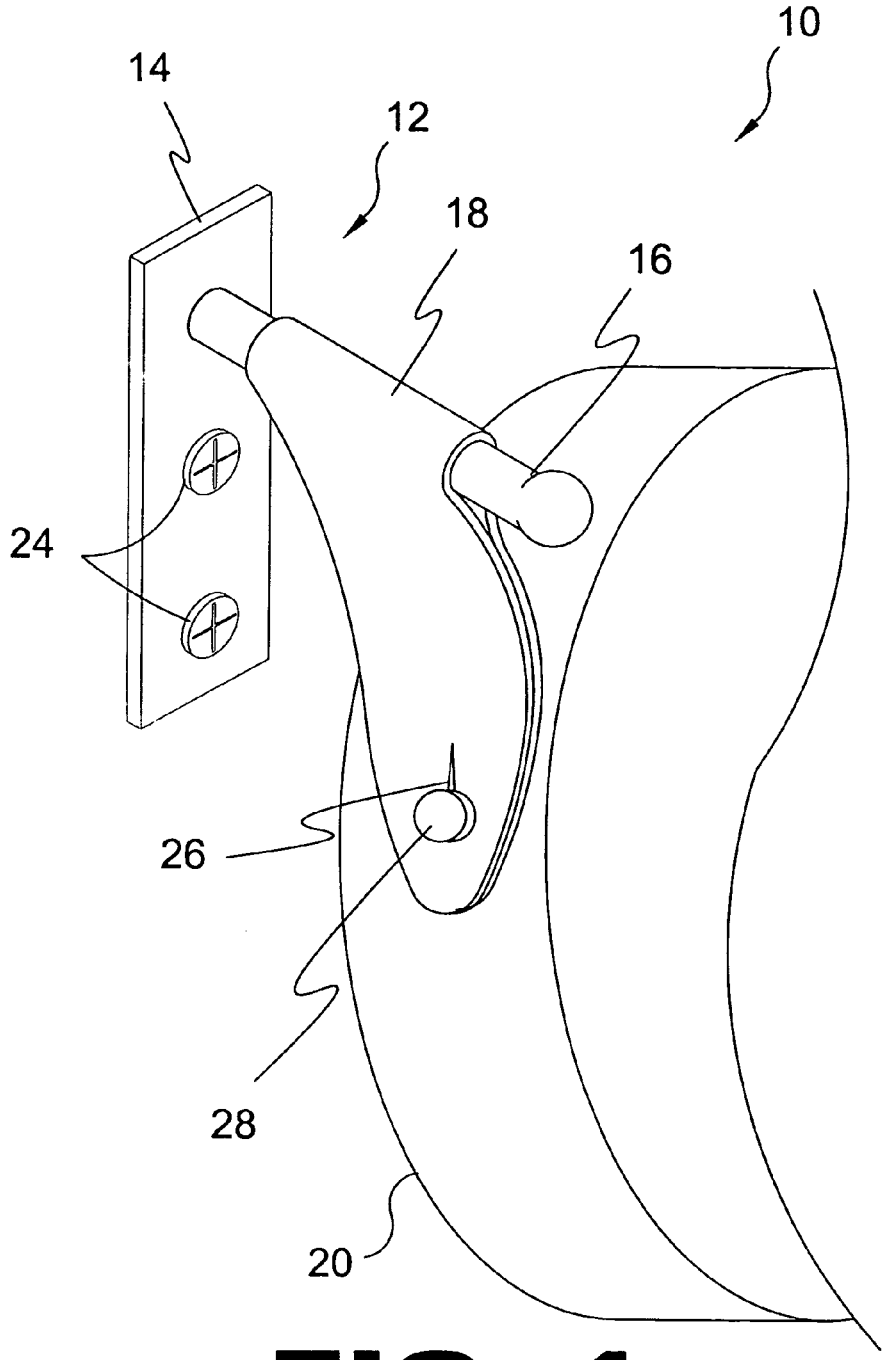
FIG. 4 is a detailed partial perspective view of the present invention.

FIG. 4 is a detailed partial perspective view of the present invention 10. The present invention is a two piece guitar hanger apparatus 10 for resting or displaying a guitar 20 in a horizontal or playing position having two brackets assemblies 12, each providing a mounting plate 14 including a dowel 16 that receives a fob 18, resembling the end of a guitar strap. Each mounting plate 14 has a pair of mounting apertures to secure the mounting plate 14 to a wall or cabinet with appropriate hardware 24 such as a screw or molly. The fob 18 provides a recess 26 to accept the strap pegs 28 of a guitar 20 to removably secure it to the bracket dowel 16. Each fob 18 is removable from the dowel 16.

Figure 5:
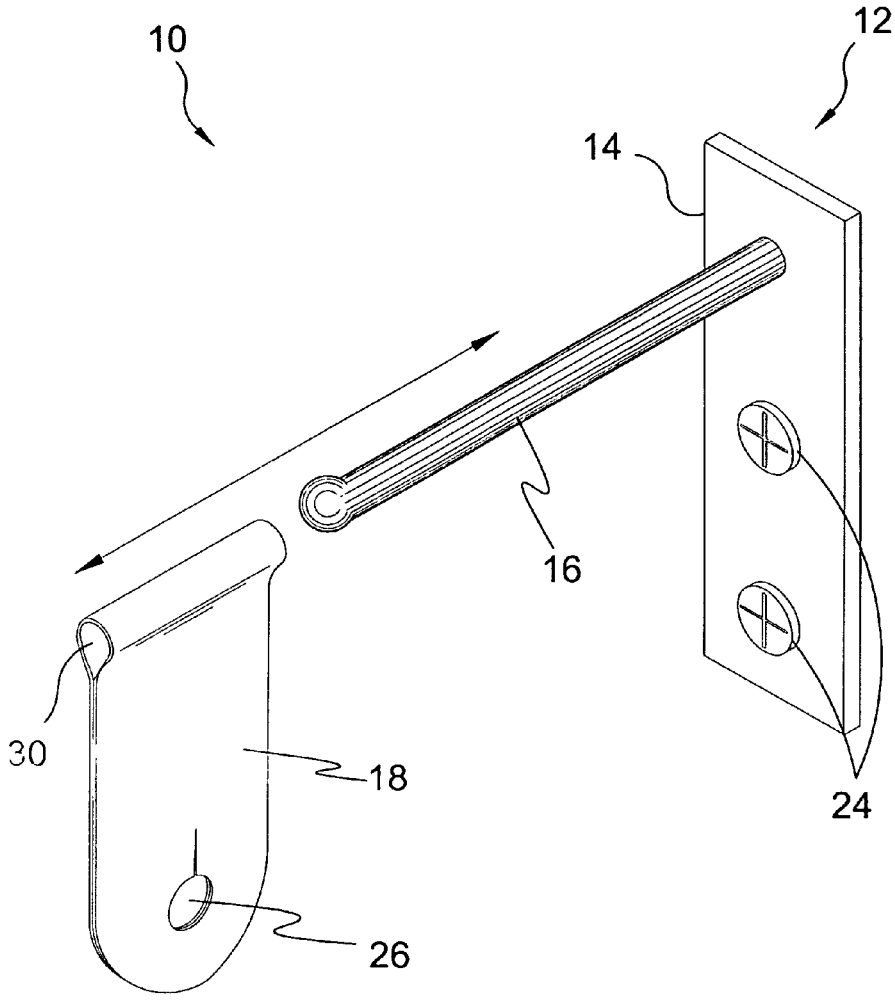
FIG. 5 is an exploded view of the present invention.

FIG. 5 is an exploded view of the present invention 10. The present invention is a two piece guitar hanger apparatus 10 for resting or displaying a guitar in a horizontal or playing position having two brackets assemblies 12, each providing a mounting plate 14 including a dowel 16 that is inserted into the mounting channel 30 of a fob 18, resembling the end of a guitar strap. Each mounting plate 14 has a pair of mounting apertures to secure the mounting plate 14 to a wall or cabinet with appropriate hardware 24 such as a screw or molly. The fob 18 provides a recess 26 to accept the strap pegs of a guitar to removably secure it to the bracket dowel 16. Each fob 18 is removable from the dowel 16.

Figure 6:
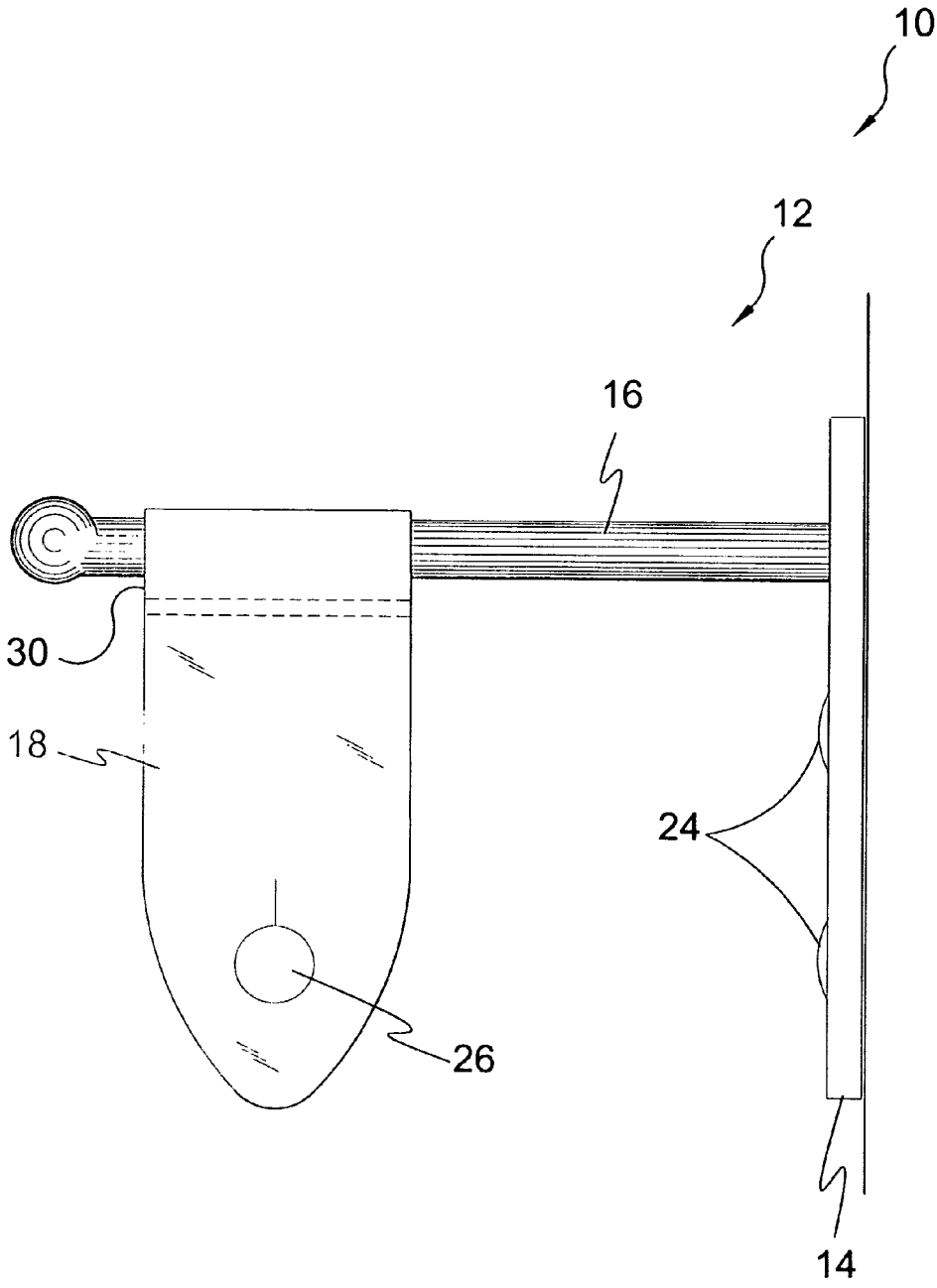
FIG. 6 is a side view of the present invention.

FIG. 6 is a side view of the present invention 10. The present invention is a two piece guitar hanger apparatus 10 for resting or displaying a guitar in a horizontal or playing position having two brackets assemblies 12, each providing a mounting plate 14 including a dowel 16 that is inserted into the mounting channel 30 of a fob 18, resembling the end of a guitar strap. Each mounting plate 14 has a pair of mounting apertures to secure the mounting plate 14 to a wall or cabinet with appropriate hardware 24 such as a screw or molly. The fob 18 provides a recess 26 to accept the strap pegs of a guitar to removably secure it to the bracket dowel 16. Each fob 18 is removable from the dowel 16.

Figure 7:
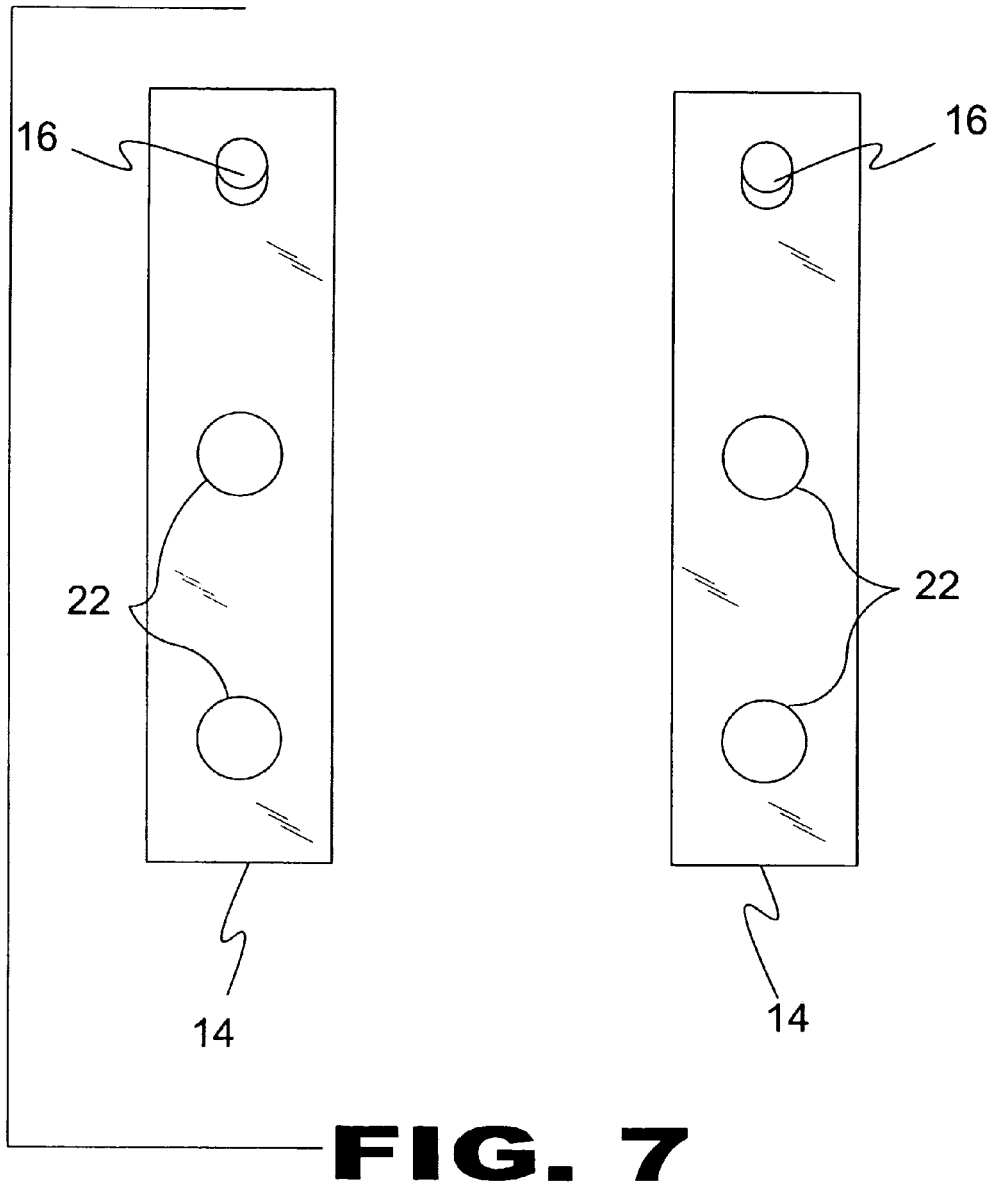
FIG. 7 is a frontal view of the present invention.

FIG. 7 is a frontal view of the mounting plate 14 and related dowel 16. The mounting plate 14 includes mounting apertures 22 through which the hardware is inserted to secure it to the surface to be mounted.

Figure 8:
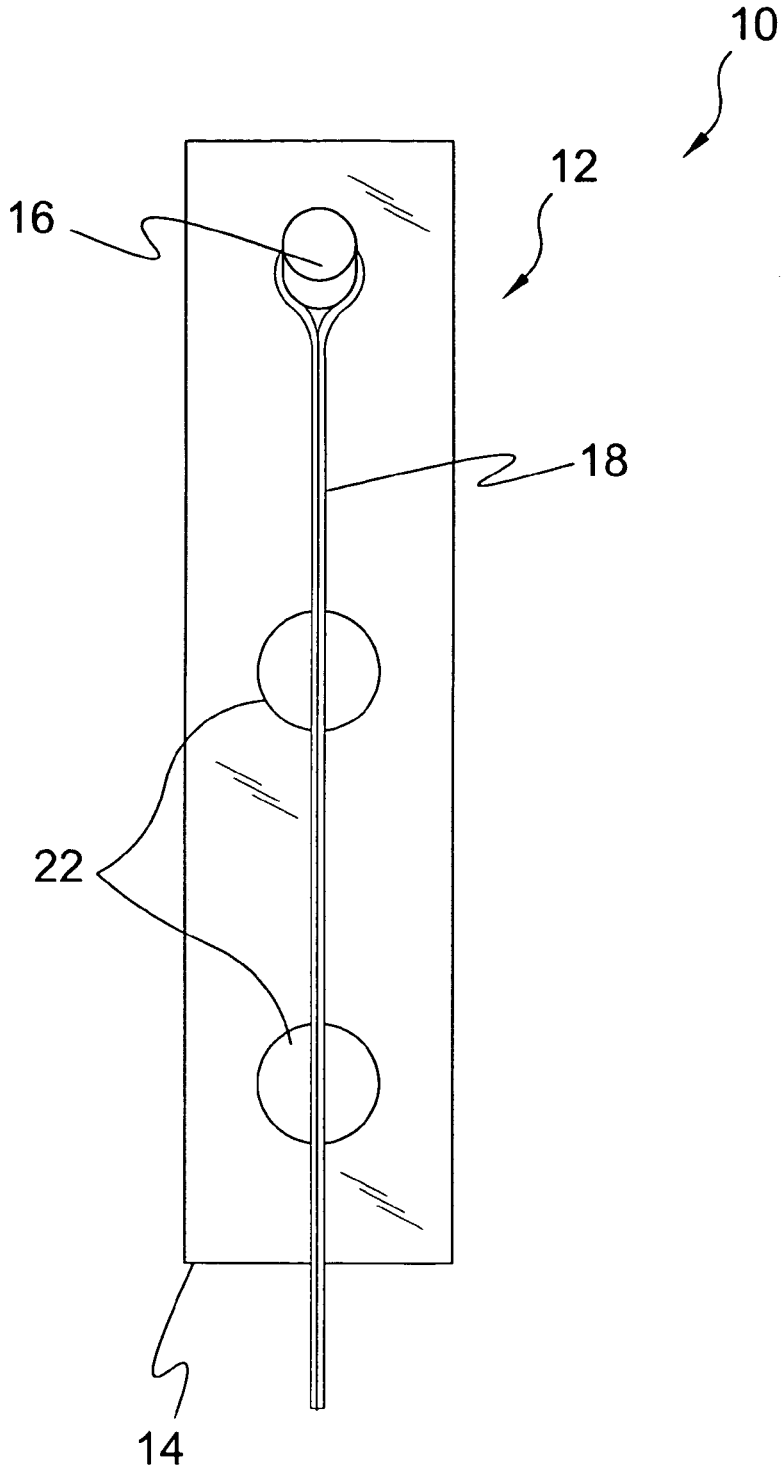
FIG. 8 is a frontal view of the present invention.

FIG. 8 is a frontal view of the bracket assembly 12 of the present invention 10. The mounting plate 14 includes mounting apertures 22 through which the hardware is inserted to secure it to the surface to be mounted and the fob 18 is installed on the dowel 16.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention

What is claimed is:

1. A guitar hanger apparatus for hanging a guitar on a wall, cabinet or other like vertical surface for display and storage purposes, said guitar hanger apparatus comprising a pair of bracket assemblies with each said bracket assembly comprising:

a) a mounting plate;

b) an elongate dowel extending from said mounting plate;

c) a fob strap that is removably attachable to said dowel wherein said mounting plate further includes means for mounting on a vertical surface;

wherein said mounting plate mounting means includes at least one mounting aperture disposed therein;

wherein said mounting plate has a plurality of mounting apertures;

wherein said mounting plate has two mounting apertures;

wherein said fob strap includes means for releasably attaching to said dowel;

wherein said fob strap attachment means is a mounting channel disposed on the top portion of said fob strap and sized to accommodate said dowel;

wherein said fob strap is fabricated of a sturdy, flexible material;

wherein said fob strap is fabricated of cloth; and wherein said fob strap further includes a means for releasably attaching to the strap pegs of a guitar.

2. The guitar hanger apparatus recited in claim 1, wherein said guitar attachment means is a recess disposed in a lower portion of said fob strap.

3. The guitar hanger apparatus recited in claim 2, wherein said mounting plate is secured to the vertical surface with hardware that is inserted through each said mounting aperture and imbedded in said surface.

4. The guitar hanger apparatus recited in claim 3, wherein said hardware is a screw.

5. The guitar hanger apparatus recited in claim 3, wherein said hardware is a molly.

6. The guitar hanger apparatus recited in claim 3, wherein said mounting bracket assemblies are installed upon said vertical surface in spaced apart relation.

7. The guitar hanger apparatus recited in claim 6, wherein said guitar pegs are inserted into said fob strap recesses and suspended therefrom for display and storage.

* * * * *